US009670788B2

(12) United States Patent
Hoyland et al.

(10) Patent No.: US 9,670,788 B2
(45) Date of Patent: Jun. 6, 2017

(54) COMPOSITE AEROFOIL VANE

(71) Applicant: ROLLS-ROYCE PLC, London (GB)

(72) Inventors: Matthew Ashley Charles Hoyland, Chesterfield (GB); Dale Edward Evans, Derby (GB); Bijoysri Khan, Derby (GB)

(73) Assignee: ROLLS-ROYCE plc, London (GB)

( * ) Notice: Subject to any disclaimer, the term of this patent is extended or adjusted under 35 U.S.C. 154(b) by 524 days.

(21) Appl. No.: 14/185,390

(22) Filed: Feb. 20, 2014

(65) Prior Publication Data

US 2014/0286765 A1 Sep. 25, 2014

(30) Foreign Application Priority Data

Mar. 21, 2013 (GB) ..... 1305180.0

(51) Int. Cl.

| | |
|---|---|
| ***F01D 9/04*** | (2006.01) |
| ***F01D 5/28*** | (2006.01) |
| ***F01D 9/02*** | (2006.01) |
| ***F01D 25/00*** | (2006.01) |
| ***F04D 29/02*** | (2006.01) |
| ***F04D 29/54*** | (2006.01) |

(52) U.S. Cl.

CPC ..... *F01D 5/282* (2013.01); *F01D 9/02* (2013.01); *F01D 9/041* (2013.01); *F01D 25/005* (2013.01); *F04D 29/023* (2013.01); *F04D 29/542* (2013.01); *F05B 2280/6003* (2013.01); *F05B 2280/6013* (2013.01); *F05D 2300/6034* (2013.01)

(58) Field of Classification Search

CPC ..... F01D 9/041; F01D 9/042; F01D 25/005; F01D 2300/614; F05B 2280/6013; F05B 2280/6003

See application file for complete search history.

(56) References Cited

U.S. PATENT DOCUMENTS

| | | | | |
|---|---|---|---|---|
| 5,308,228 | A | 5/1994 | Benoit et al. | |
| 5,509,781 | A * | 4/1996 | Boszor | B32B 5/28 29/889.71 |
| 5,605,441 | A * | 2/1997 | Boszor | B32B 5/28 29/889.71 |
| 2006/0257260 | A1 | 11/2006 | Dambrine et al. | |
| 2006/0275132 | A1 | 12/2006 | McMillan | |
| 2011/0176927 | A1 | 7/2011 | Alexander et al. | |
| 2011/0182743 | A1 | 7/2011 | Naik | |
| 2012/0257983 | A1* | 10/2012 | Williams | F01D 5/282 416/230 |
| 2013/0089429 | A1 | 4/2013 | Nunez et al. | |

OTHER PUBLICATIONS

Sep. 16, 2013 British Search Report issued in British Application No. 1305180.0.

* cited by examiner

*Primary Examiner* — Jermie Cozart
(74) *Attorney, Agent, or Firm* — Oliff PLC

(57) ABSTRACT

A composite aerofoil vane for a gas turbine engine extends in use in a generally radial direction across an axially- and circumferentially-extending annular duct. The vane comprises a plurality of first reinforcing fibers extending in a generally radial direction and a plurality of second reinforcing fibers extending in generally axial and circumferential directions. The second fibers are interlaced with the first fibers so as to form a more unified and integrated structure, and to prevent the first reinforcing fibers from moving relative to one another.

9 Claims, 3 Drawing Sheets

COMPOSITE AEROFOIL VANE

BACKGROUND

This invention relates to non-rotating aerofoil vanes for gas turbine engines, and more particularly to fibre-reinforced composite vanes.

Gas turbine engines comprise stages of rotating aerofoil blades, which turn the gas flow and either do work on, or extract work from, the gas flow (depending on whether they are compressor or turbine blades). Interposed between the stages of rotating blades are stages of non-rotating aerofoil vanes, whose primary purpose is to straighten the gas flow to deliver it at the correct angle of incidence to the next stage of rotating blades.

Vanes are also provided elsewhere in gas turbine engines where straightening of the gas flow is required. FIG. 1 shows a sectional view of part of a gas turbine engine, which has a principal rotational axis X-X. In use, air enters the engine through an annular intake 10, and passes along a duct defined by an inner annulus wall 12 and an outer annulus wall 14. The air passes through an annular array of rotating fan blades 16, which impart energy to the air flow, following which an annular splitter 18 divides the air flow into two streams. A core air flow 20 passes through an annular array of vanes 21, commonly known as engine section stators, and thereafter through the engine core. A bypass flow 22 passes through the bypass duct 24. The details of operation of these two streams are well known and will not be described here. The bypass flow passes through an annular array of fan outlet guide vanes 26. The vanes 26 straighten the air flow leaving the fan blades 16, and thereby reduce the aerodynamic losses in the bypass duct 24.

SUMMARY

In addition to their aerodynamic function, fan OGVs must also resist aerodynamic loads and loads arising from impact of foreign objects. Depending on the engine design, they may also have to carry structural loads. Current trends in engine architecture are for structural OGVs, and with the deletion of features such as A-frames and rear fan cases the structural requirements on the OGVs are becoming even more challenging.

In use, OGVs have to resist buckling loads, tensile loads and torsional assembly loads exerted by a number of external forces, including gust loading on the nacelle and fan blade off. The OGVs must also maintain their integrity under bow and torsional vibration.

Fan OGVs are commonly made from metal, and both hollow and solid metal vanes are known. It is also known to make them from fibre-reinforced composite material.

Organic matrix composites are commonly considered where a weight reduction is desired. However, in the case of OGVs the conflicting loading requirements, and in particular the torsional vibration requirement, mean that a composite vane must be some 35% thicker than a corresponding metal one, which is detrimental to the weight and aerodynamic performance.

It is therefore an aim of this invention to provide a composite aerofoil vane with superior mechanical properties to known vanes, so that the thickness penalty compared with a metal vane is reduced to an acceptable level.

The invention provides a composite aerofoil vane for a gas turbine engine as set out in the claims.

BRIEF DESCRIPTION OF THE DRAWINGS

Embodiments of the invention will now be described in more detail, with reference to the attached drawings, in which.

DETAILED DESCRIPTION OF EMBODIMENTS

Figure 1:
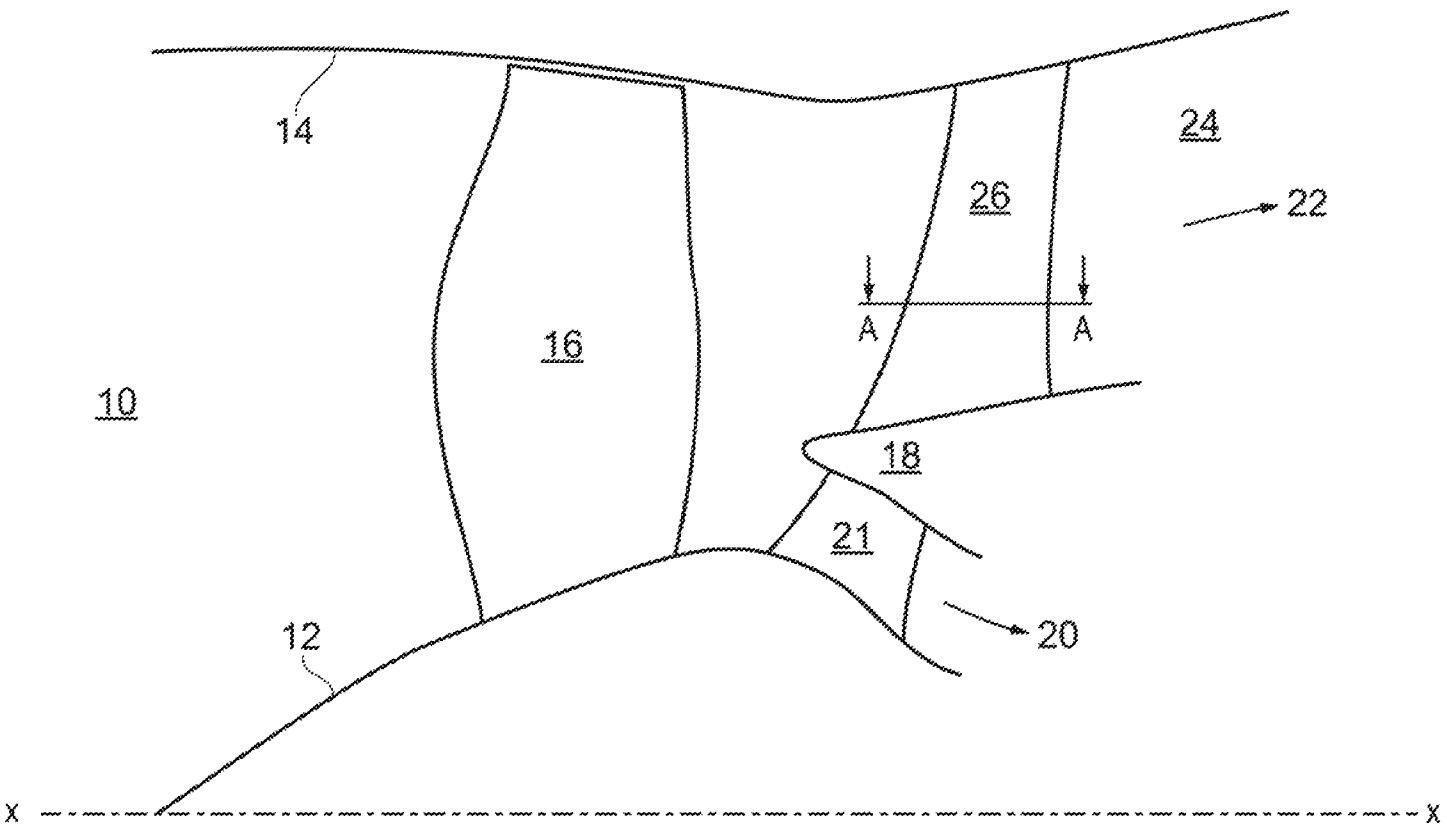
FIG. 1 PRIOR ART
FIG. 1 shows a sectional view of part of a gas turbine engine.
Figure 2:
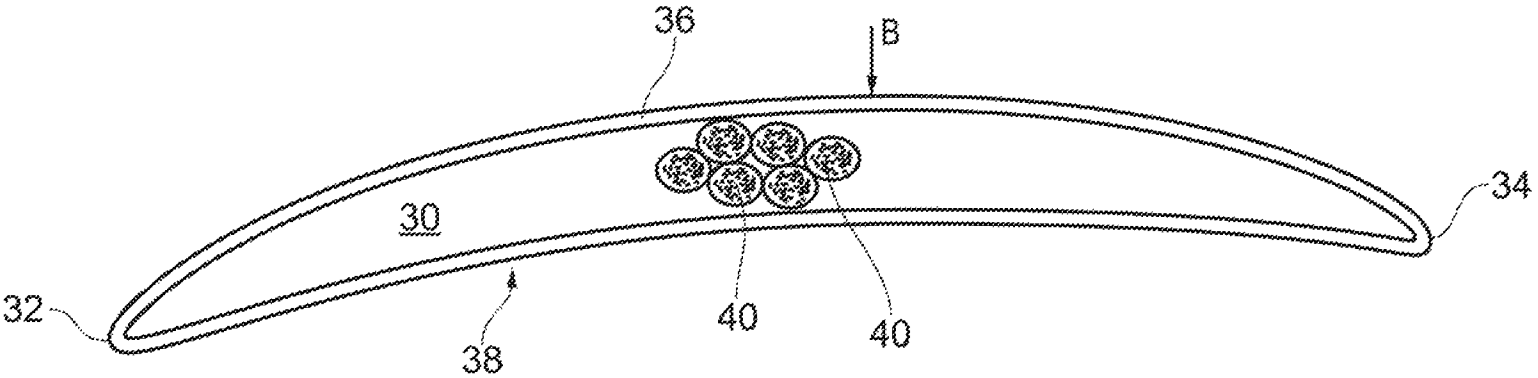
FIG. 2 PRIOR ART
FIG. 2 shows a cross-section of a known composite aerofoil vane.
Figure 3:
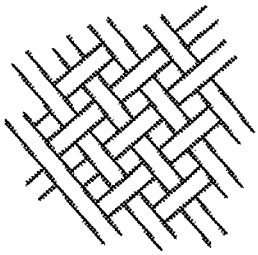
FIG. 3 PRIOR ART
FIG. 3 shows a view on arrow B of FIG. 2.

FIG. 2 shows a cross-section of a known composite aerofoil vane 30, approximately at the position shown by the line A-A in FIG. 1. The vane 30 extends in a generally axial direction between a leading edge 32 and a trailing edge 34. The aerodynamic profile of the vane 30 is formed by a shell 36 formed of one or more layers of woven ±45° fibres (that is, fibres whose directions lie at 45° either side of the axial direction of the vane). FIG. 3 shows a view on arrow B of FIG. 2, and illustrates the weave of the shell fibres. In this embodiment, the shell comprises two layers of ±45° fibres, but it will be appreciated that in different embodiments fewer or more layers may be used. Furthermore, it will be appreciated that other weave patterns and fibre orientations may be employed. Other common fibre orientations are 0°, ±60° and 90°. The ±45° woven fabric of the shell typically provides substantially all the torsional stiffness of the vane 30. The outer surface 38 of the shell 36 also provides a smooth gas-washed surface for the vane 30, which is important for its aerodynamic performance.

Within the shell 36 are a plurality of bundles or tows 40 of unidirectional fibres, oriented in a generally radial direction (substantially at 90° to the axial direction). There will also be a relatively small number of fibres at 0° to the axial direction, loosely connecting the dry fibres that form the tows. Only a few tows 40 are shown, but in practice they would fill the space within the shell 36. Each tow 40 comprises typically 12000-24000 fibres, though it may have as few as 1000. Sets of tows can be bundled together to speed production. The unidirectional tows provide substantially all the radial strength and bow stiffness of the vane 30. The remaining space within the shell is filled with resin, and the whole structure is cured together. Typically, the dry fibres are placed in a mould tool and the resin is introduced in a resin transfer moulding (RTM) process.

Usually, the shell layers and the unidirectional bundles will be made from the same fibre-resin system, for example AS7/IM7 intermediate modulus fibres in an RTM6/PR520 epoxy resin. Of course, alternative fibre/resin systems may be used to suit particular applications—for example, an HTS fibre (higher strength) with BMI resin (higher temperature).

This two-part structure, in which substantially all the torsional stiffness of the vane is provided by the outer shell 36 and substantially all the bow stiffness and radial strength is provided by the unidirectional tows 40, is relatively inefficient and means that a vane of this construction must typically be some 35% thicker than an equivalent metal vane. It will be appreciated that such an increase in thickness is very damaging to the aerodynamic performance of the vane. A further disadvantage is that the increased bulk of the vane inevitably leads to an increase in weight and manufacturing cost.

The inventors have realised that a more integrated structure can be more structurally efficient, and can therefore deliver the required stiffness and strength with a smaller aerodynamic penalty. Vanes according to the invention are, furthermore, lighter and offer a reduced performance penalty compared with known composite vanes. Manufacturing costs may also be reduced, although there is a trade-off between increased complexity of the vane architecture and a reduction in material input.

Figure 4:
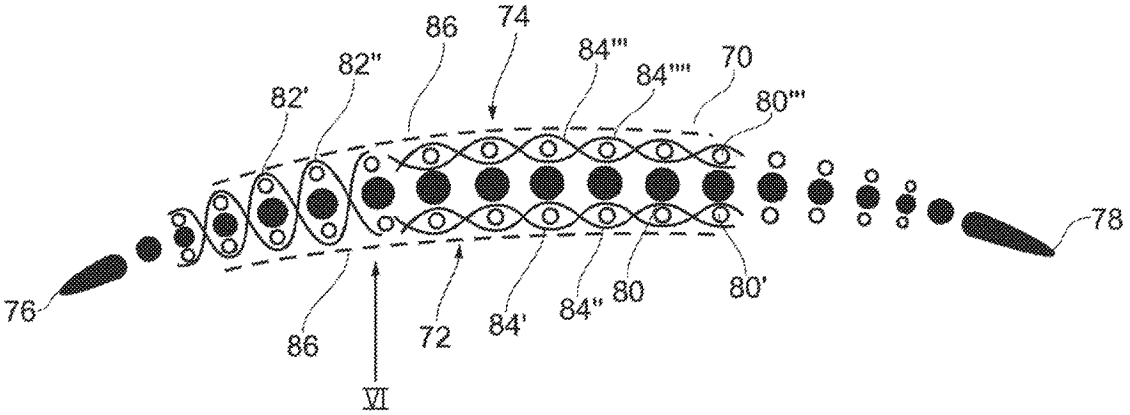
FIG. 4 shows a cross-section of a first embodiment of a composite aerofoil vane according to the invention.

FIG. 4 shows a cross-section of a first embodiment of a composite aerofoil vane 70 according to the invention. (As for FIG. 2, the cross-section is approximately at the position shown by the line A-A in FIG. 1.) The vane 70 has a pressure surface 72 and a suction surface 74, which extend in a generally axial direction between a leading edge 76 and a trailing edge 78.

The vane comprises a plurality of bundles, tows or structures 80 of first fibres. These fibres are unidirectional and are aligned in a generally radial direction. By "tows" is meant sheaves of aligned fibres, which may be dry (i.e. with no resin between them). By "structures" is meant solid or hollow pre-cured rods or bundles of fibres. If the tows are formed of dry fibres they will generally be loosely tied together. A fibre bundle may be made from several tows and these may be of different materials; for example, a bundle may comprise tows of carbon, glass and aramid fibres. Because different fibres have different properties, the mix of fibres may be varied to provide optimum properties for different regions of the vane. This is illustrated in FIG. 4 by the two different types of bundles 80 and 80'. Interlaced with the tows 80 are a plurality of second fibres 82, 84. These fibres run in generally axial and circumferential directions. These fibres may be arranged in rods, bundles or tows. As with the first fibres, the second fibres 82, 84 may be of different materials, separately or mixed within a tow or bundle; for example, carbon, aramid or metal fibres.

The second fibres 82, 84 are provided over at least part of the span of the vane. They can be over any part of the span, but will generally be provided in the middle two-thirds where enhanced stiffness will improve the resistance to bow and torsional vibration. The spacing, in the radial direction, of the second fibres can be adjusted to suit the particular stiffness requirements, and ultimately will be limited by the fibre gauge (finer fibres permitting a higher volume fraction of fibres).

The leading edge and trailing edge portions 76, 78 are constructed in much the same way as the first fibre bundles 80, 80', but are appropriately shaped to define the leading and trailing edges of the vane. Typically, the vanes will be provided with metal leading edge protection made from stainless steel or from nickel alloy.

Figure 5:
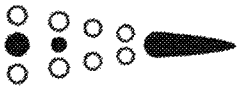
FIG. 5 shows a partial cross-section of the trailing edge region of a second embodiment of a composite aerofoil vane according to the invention.

The second fibres are arranged in two distinct patterns, which alternate along the radial direction of the vane. The spacing of the second fibres in the radial direction will vary as required. In the first pattern, second fibres 82' and 82" are interlaced between the tows 80 so as to extend from the pressure surface 72 to the suction surface 74 of the vane. In the second pattern, second fibres 84' and 84" are interlaced between the tows 80' nearest to the pressure surface 72 of the vane, but do not pass through the central portion of the vane. Similarly, second fibres 84''' and 84'''' are interlaced between the tows 80''' nearest to the suction surface 74 of the vane. Both second fibres 82 and second fibres 84 can extend over the full chord, from leading edge to trailing edge. In FIG. 5, the axial extent of these fibres is limited to different axial zones only to improve the clarity of the drawing.

Figure 6:
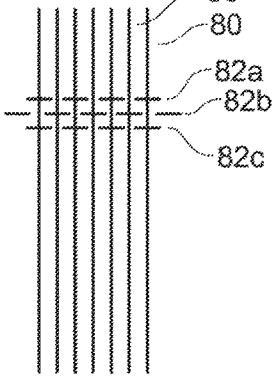
FIG. 6 shows a schematic side view of part of the vane of FIG. 4, in the direction of the arrow VI.

FIG. 6 shows a side view of part of the vane of FIG. 4, in the direction of the arrow VI. Second fibres 82 are interlaced between the first fibres 80. It can be seen that the weaving pattern alternates by half a pitch between successive second fibres 82*a*, 82*b*, 82*c*. Although it is not shown in FIG. 6, the weaving pattern will also alternate in exactly the same way between successive second fibres 84, and (in places where second fibres 82 and 84 are adjacent to each other) between successive second fibres 82, 84.

These arrangements of first and second fibres can be produced on a loom, using a 3D weaving machine or using robotic placement. It would also be possible to manufacture them by hand, although of course this would be slower. In one embodiment of the invention, the fibres are woven into a dry fibre pre-form, which is then fitted into a mould tool. Resin is injected into the mould tool, in a known resin transfer moulding process, and the component is then cured in the mould.

In this way, the tows 80 of first fibres are bound together by the second fibres 82 and 84, so as to form a more unified and integrated structure. In particular, the tows 80 are prevented from moving relative to one another as shown in FIG. 3. The result is a vane with much better mechanical properties; in particular, the torsional stiffness is greatly improved by the interlacing such that an adequately stiff vane can be made with only a small thickness penalty compared with a metal vane.

FIG. 5 shows the trailing edge region of a second embodiment of a vane according to the invention, in which a different combination of first fibre bundles 80, 80' is employed to form the desired trailing edge shape.

The vane 70 may optionally be provided with a thin surface layer 86. This helps improve the integrity of the thin leading and trailing edges of the vane, and also helps to improve the profile tolerance and surface finish of the aerodynamic shape of the gas-washed surface. In contrast to the shell of the prior art vane of FIG. 2, the surface layer is thin and does not contribute to the mechanical properties of the vane. The surface layer may comprise a fine woven layer wrapped or braided around the vane. The surface layer may comprise a woven mat of reed-like flat elements of polymer or metal. A woven structure will generally be easier to handle, and will be easier to attach to the structure with infused resin than a continuous sheet would be. It will also be more resistant to delamination. As discussed previously, the vane will typically have metal leading edge protection. In line with normal practice, erosion protection (such as a layer of polyurethane) may be applied to the leading edge and/or pressure surface of the vane. If required, colourants or barrier layers (against UV, moisture etc.) may be applied or may be mixed with the surface layer.

The invention claimed is:

1. A composite aerofoil vane for a gas turbine engine, the vane in use extending in a generally radial direction across an axially- and circumferentially-extending annular duct, the duct in use carrying a gas flow, the vane comprising:

a plurality of first reinforcing fibres extending in a generally radial direction and a plurality of second reinforcing fibres extending in generally axial and circumferential directions, the second fibres being interlaced with the first fibres, wherein at least some of the second fibres are interlaced with at least some of the first fibres so as to extend through the whole circumferential thickness of the vane.

2. The vane of claim 1, in which the second fibres are arranged to substantially define the aerofoil surface of the vane and to provide a gas-washed surface.

3. The vane of claim 1, in which at least some of the second fibres are interlaced with at least some of the first fibres so as to not extend through the whole circumferential thickness of the vane.

4. The vane of claim 1, in which the first fibres comprise generally radially-extending bundles, tows or structures.

5. The vane of claim 1, in which the first fibres comprise generally radially-extending hollow structures.

6. The vane of claim 1, further comprising a surface layer outward of the second fibres.

7. The vane of claim 6, in which the surface layer comprises fibres.

8. The vane of claim 7, in which the surface layer comprises a fine, thin woven or braided fabric or matting.

9. The vane of claim 6, in which the surface layer is wrapped around the vane.

* * * * *